US005660538A

United States Patent [19]

Higashiyama et al.

[11] Patent Number: 5,660,538

[45] Date of Patent: Aug. 26, 1997

[54] SUCTION MECHANISM OF A FLUID DISPLACEMENT APPARATUS

[75] Inventors: Akiyoshi Higashiyama, Kodema-gun; Masaaki Fujita, Isesaki, both of Japan

[73] Assignee: Sanden Corporation, Gunma, Japan

[21] Appl. No.: 569,451

[22] Filed: Dec. 8, 1995

[30] Foreign Application Priority Data

Dec. 8, 1994 [JP] Japan ..... 6-304751

[51] Int. Cl.[6] ..... F01C 1/04; F01C 19/00

[52] U.S. Cl. ..... 418/55.4; 418/149

[58] Field of Search ..... 418/55.1, 55.4, 418/55.5, 149; 417/572

[56] References Cited

U.S. PATENT DOCUMENTS

| | | | |
|---|---|---|---|
| 4,571,163 | 2/1986 | Sakamoto et al. | 418/55.1 |
| 4,597,724 | 7/1986 | Sato et al. | 418/55.1 |
| 4,722,676 | 2/1988 | Sugimoto | 418/55.4 |
| 4,904,164 | 2/1990 | Mabe et al. | 418/55.1 |
| 4,911,620 | 3/1990 | Richardson, Jr. et al. | 418/55.5 |
| 4,913,635 | 4/1990 | Ochiai et al. | 418/55.4 |
| 5,256,042 | 10/1993 | McCullough et al. | 418/55.5 |

FOREIGN PATENT DOCUMENTS

| | | | |
|---|---|---|---|
| 6053689 | 3/1985 | Japan | 418/55.4 |
| 3-88985 | 4/1991 | Japan | 418/55.4 |
| 5141201 | 6/1993 | Japan | 418/55.4 |

*Primary Examiner*—John J. Vrablik
*Attorney, Agent, or Firm*—Baker & Botts, L.L.P.

[57] ABSTRACT

A fluid displacement apparatus includes a housing having a fluid inlet and fluid outlet. A suction chamber is formed between the first end of the displacement mechanism and the housing and communicates with the fluid inlet port. A discharge chamber is formed between the second end of the displacement mechanism and the housing and communicates with a hollow space. The hollow space is created between the inner block and the housing and communicates with the outlet port. Sealing devices are disposed between the suction chamber and the fluid inlet port for sealing the mating surfaces between the suction chamber and the fluid inlet port. The suction mechanism of the fluid displacement apparatus is thus easily assembled.

8 Claims, 4 Drawing Sheets

SUCTION MECHANISM OF A FLUID DISPLACEMENT APPARATUS

BACKGROUND OF THE INVENTION

1. Field of the Invention

The present invention relates to a fluid displacement apparatus, and more particularly, to a suction port mechanism of a scroll type refrigerant compressor used in an automotive air conditioning system.

2. Description of the Prior Art

Suction port mechanisms for fluid displacement apparatuses are well known in the prior art. For example, FIG. 1 depicts a suction port mechanism used in a scroll type refrigerant compressor as described in U.S. Pat. No. 4,596,520 to Arata et al. A compressor section 2 and electric motor section 3 are encased in hermetic housing 1. Compressor section 2 includes a stationary scroll member 5 and an orbiting scroll member 6 which form closed compression chambers 9 therebetween. Stationary scroll member 5 has a disc-shaped end plate 5*a* and a wrap 5*b* extending from end plate 5*a*. Wrap 5*b* is shaped as an involute curve. A discharge port 10 and suction port 7 are respectively formed in the central and peripheral regions of end plate 5*a*. Orbiting scroll member 6 has a disc-shaped end plate 6*a*, wrap 6*b* formed on one side of end plate 6*a* and having a contour conforming with that of wrap 5*b* of stationary scroll member 5, and a boss 6*c* on the other side of end plate 6*a*. Boss 6*c* receives an eccentric shaft portion 14*a* of a rotary shaft 14. Eccentric shaft portion 14*a* causes an orbiting movement of orbiting scroll member 6. Rotary shaft 14 is rotatably supported by a bearing 11*a* provided on a central portion of frame 11. Stationary scroll member 5 is fixed to frame 1 by a plurality of bolts, not shown, while orbiting scroll member 6 is supported by frame 11 through an Oldham coupling mechanism 12. Orbiting scroll member 6, therefore, makes an orbiting movement with respect to stationary scroll member 5 without rotating about its own axis. Rotary shaft 14 is connected at its lower end to an electric motor 3. Discharge port 10 opens to a discharge chamber 1*a* which, in turn, communicates with a lower chamber 1*b* through a passage, not shown, and further leads to a discharge pipe 19 which penetrates the wall of the hermetic housing. Further, a back pressure chamber 20 is defined by the rear surface of orbiting scroll member 6 and frame 11. The intermediate pressure between the suction pressure (pressure of the low-pressure side) and the discharge pressure is applied to back pressure chamber 20 to counteract the axial force produced by the gas under compression in the compression chambers between both scroll members. The intermediate pressure is introduced into back pressure chamber 20 through a small aperture 21 formed in end plate 6*a*.

Suction pipe 17 extends through the wall of hermetic housing 1 and connects with the suction port 7 formed in stationary scroll member 5. Suction pipe 17 is forcibly inserted into suction port 7 to obtain an adequate seal between the peripheral surface of suction pipe 17 and the inner wall of suction port 7. Suction pipe 17 is then welded to hermetic housing 1.

Scroll member 5 must be assembled within hermetic housing 1 so that suction port 7 is aligned with the hole in hermetic housing 1. Suction pipe 17 may then be force fitted into hermetic housing 1. The requirement of aligning scroll member 5 with the hole in housing 1 is time consuming and complicates the assembly process.

SUMMARY OF THE INVENTION

Accordingly, it is an object of the present invention to provide a fluid displacement apparatus which is easy to assemble.

In order to obtain the above and other objects, the fluid displacement apparatus according to the present invention includes a housing having a fluid inlet and fluid outlet. A fluid displacement mechanism having a first end and a second end is disposed within the housing. A driving mechanism is disposed in the housing and operatively connected to the fluid displacement mechanism. An inner block is fixedly disposed within the housing and supports a portion of the driving mechanism. A suction chamber is formed between the first end of the fluid displacement mechanism and the housing and communicates with the fluid inlet port. A discharge chamber is formed between the second end of the fluid displacement mechanism and the housing and communicates with a hollow space. The hollow space is formed between the inner block and the housing and communicates with the outlet port. A sealing device is disposed between the suction chamber and the fluid inlet port for sealing the mating surfaces therebetween.

Other objects, features and advantages of the present invention will be apparent to persons of ordinary skill in the art in view of the following detailed description and the accompanying drawings.

DETAILED DESCRIPTION OF THE PREFERRED EMBODIMENTS

Figure 1:
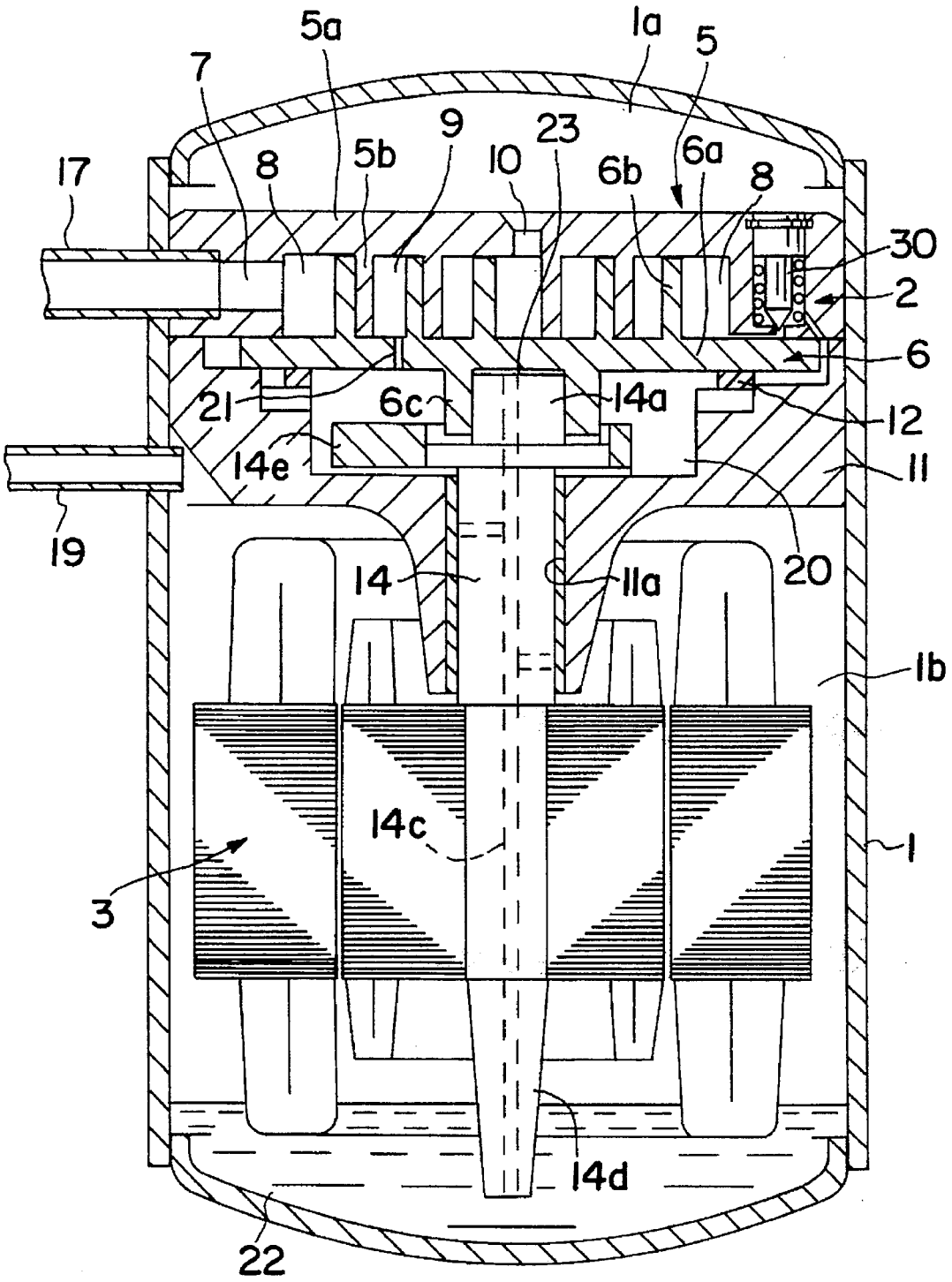
FIG. 1 PRIOR ART
FIG. 1 is a longitudinal sectional view of a hermetic scroll compressor in accordance with the prior art.
Figure 2:
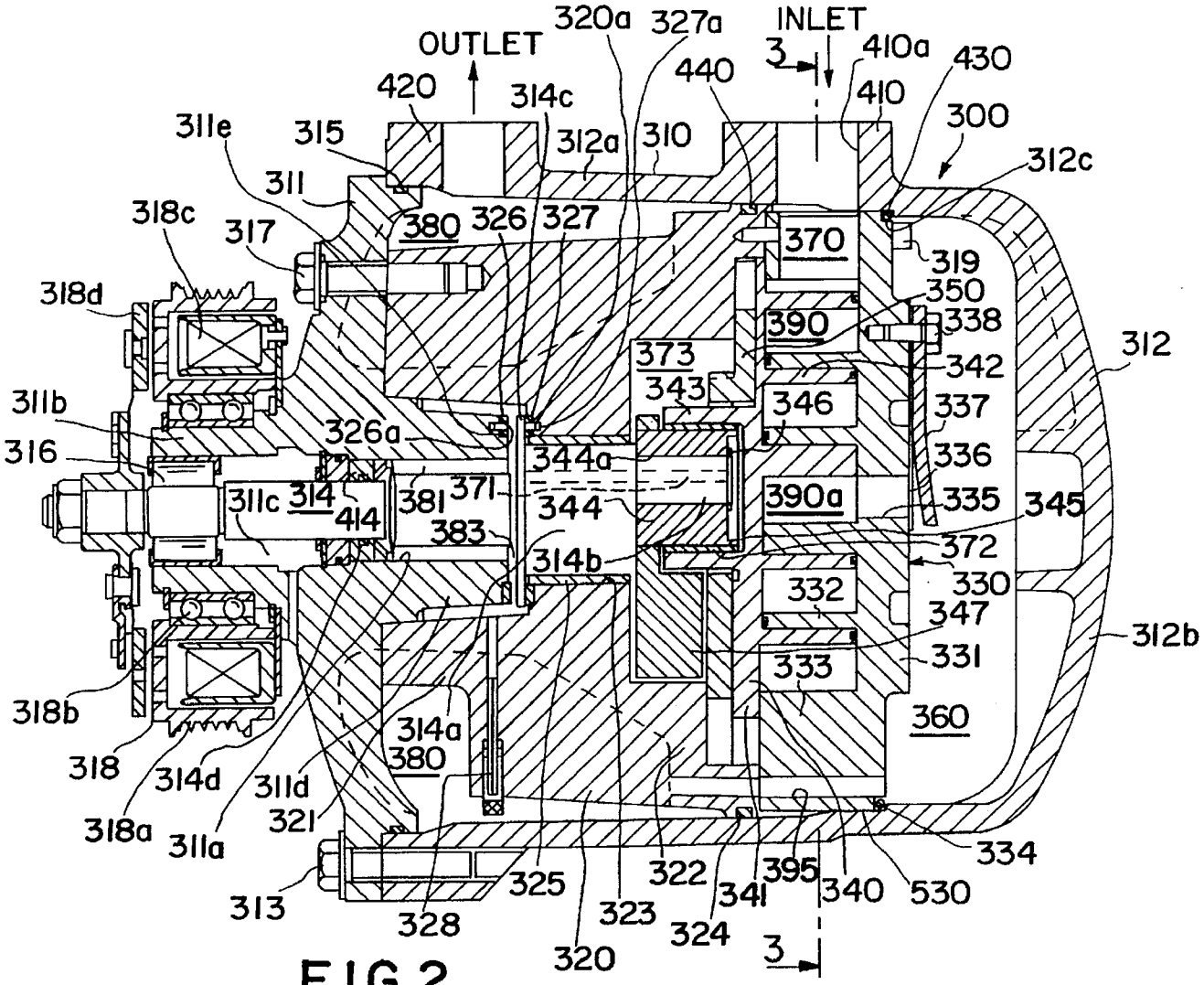
FIG. 2 is a longitudinal section view of a hermetic scroll compressor in accordance with a first preferred embodiment.

With reference to FIG. 2, there is shown a fluid displacement apparatus, e.g., a scroll type refrigerant compressor, in accordance with a first preferred embodiment. Furthermore, in FIG. 2, for purposes of explanation only, the left side of the figure will be referenced as the forward end or front of the compressor, and the right side of the figure will be referenced as the rearward end or rear of the compressor.

With reference to FIG. 2, compressor 300 includes compressor housing 310 having front end plate 311 and cup-shaped casing 3 12 which is secured to front end plate 311 by a plurality of bolts 313. An opening 311*a* is formed in the center of front end plate 311, through which drive shaft 314, which is made of steel, passes. An open end of cup-shaped casing 312 is covered by front end plate 311, and the mating surfaces between front end plate 311 and cup-shaped casing 312 are sealed by first O-ring 315. First annular sleeve 311*b* forwardly projects from a periphery of opening 311*a* to surround a front end portion of drive shaft 314 and define shaft seal cavity 311*c* therein. Shaft seal mechanism 414 is disposed within shaft seal cavity 311*c* and is mounted about drive shaft 314. Shaft seal mechanism 414 seals the interior of compressor housing 310 to prevent refrigerant and lubricating oil from escaping though opening 311*a*.

Drive shaft 314 is rotatably supported by first annular sleeve 311*b* through radial needle bearing 316. Second annular sleeve 311*d* rearwardly projects from the periphery of opening 311*a* so as to surround an inner end portion of drive shaft 314.

Inner block 320 has a front annular projection 321 and a rear annular projection 322 and is disposed within the interior of housing 310. The interior of housing 310 is defined by the inner wall of cup-shaped casing 312 and the rear end surface of front end plate 311. Front annular projection 321 is fixedly attached to front end plate 311 by a plurality of bolts 317. Front annular projection 321 of inner block 320 surrounds second annular sleeve 311*d* of front end plate 311.

Drive shaft 314 has a cylindrical rotor 314*a* which is integral with and coaxially projects from an inner end surface of drive shaft 314. The diameter of cylindrical rotor 314*a* is greater than that of drive shaft 314. Cylindrical rotor 314*a* is rotatably supported by inner block 320 through radial plane bearing 325, which is fixedly disposed within an opening 323 centrally formed through inner block 320. Radial plane bearing 325 is fixedly disposed within opening 323 by, for example, forcible insertion. Pin member 314*b* is integral with, and projects from, a rear end surface of cylindrical rotor 314*a*. The axis of pin member 314*b* is radially offset from the axis of cylindrical rotor 314*a* (and the axis of drive shaft 314) by a predetermined distance.

An electromagnetic clutch 318, which is disposed around first annular sleeve 311*b*, includes pulley 318*a* which is rotatably supported on sleeve 311*b* through ball bearing 318*b*, electromagnetic coil 318*c* disposed within an annular cavity of pulley 318*b*, and armature plate 318*d* fixed on an outer end of drive shaft 314. Drive shaft 314 is connected to and driven by an external power source through electromagnetic clutch 318.

The interior of housing 310 further accommodates fixed scroll 330, orbiting scroll 340, and rotation preventing mechanism, such as Oldham coupling mechanism 350, which prevents rotation of orbiting scroll 340 during operation of the compressor.

Fixed scroll 330 includes a circular end plate 331, a first spiral element 332 affixed to or extending from a from side surface of circular end plate 331, and an outer peripheral wall 333 forwardly projecting from an outer periphery of circular end plate 331. Orbiting scroll 340, which is located in suction chamber 370, includes a circular end plate 341 and a second spiral element 342 affixed to or extending from a rear side surface of circular end plate 341. Second spiral element 342 of orbiting scroll 340 and first spiral element 332 of fixed scroll 330 interfit at an angular offset of 180° and a predetermined radial offset to make a plurality of line contacts. Therefore, at least one pair of sealed off fluid pockets 390 are defined between spiral elements 332 and 342.

Additionally, orbiting scroll 340 further includes an annular boss 343, which projects from a front end surface of circular end plate 341. Bushing 344 is rotatably disposed within boss 343 through radial plane bearing 345. Radial plane beating 345 is fixedly disposed within boss 343 by, for example, forcible insertion. Bushing 344 has a hole 344*a* axially formed therethrough. The axis of hole 344*a* is radially offset from the axis of bushing 344. As described above, pin member 314*b* is radially offset from the axis of cylindrical rotor 314*a* (and the axis of drive shaft 314) by a predetermined distance.

Pin member 314*b* is rotatably disposed within hole 344*a* of bushing 344. Pin member 314*b* projects from the rear end surface of bushing 344, and snap ting 346 is fixedly secured to the end of pin member 314*b* to prevent axial movement of pin member 314*b* within hole 344*a*. Drive shaft 314, pin member 314*b* and bushing 344 form a driving mechanism for orbiting scroll 340. Counter balance weight 347 is disposed within suction chamber 370 and is connected to a front end of bushing 344. Annular flange 314*c*, which is made of steel, for example, is positioned at the boundary of the inner end portion of drive shaft 314 and cylindrical rotor 314*a*.

First thrust plane beating 326 is fixedly disposed within an annular cut-out portion 311*e*, which is formed at an outer peripheral region of the rear end surface of second annular sleeve 311*d*, by a plurality of fixing pins 326*a*. Second thrust plane bearing 327, which is substantially identical to first thrust plane bearing 326, is fixedly disposed within a shallow annular depression 320*a*, which is formed at the front end surface of inner block 320 along a periphery of opening 323, by a plurality of fixing pins 327*a*.

Fluid passage 371 is axially formed though pin member 314*b* and cylindrical rotor 314*a*. One end of fluid passage 371 is open to an axial air gap 372 created between the rear end surface of bushing 344 and the front end surface of circular end plate 341 of orbiting scroll 340. The other end of fluid passage 371 is open to a radial air gap 381 created between the inner peripheral surface of second annular sleeve 311*d* and the outer peripheral surface of drive shaft 314. A hollow space 382 is defined by second annular sleeve 311*d* of front end plate 311 and front annular projection 321 of inner block 320. Radial air gap 381 is linked to hollow space 382 through air gap 383. Hollow space 382 is linked to a lower portion of second discharge chamber 380 through conduit 328, which is radially formed through inner block 320.

Oldham coupling mechanism 350 functions as the rotation preventing device for orbiting scroll 340, and is disposed between circular end plate 341 of orbiting scroll 340 and rear annular projection 322 of inner block 320.

Radial plane beating 325 preferably includes a pair of interleaved annular cylindrical elements. One annular element is made of, for example, steel, and another annular element is made of, for example, phosphor bronze, which is softer than steel. The pair of annular cylindrical elements are fixedly bonded to each other by, for example, sintering. The inner peripheral surface of radial plane bearing 325 consists of the phosphor bronze element, which faces the outer peripheral surface of cylindrical rotor 314*a*. As a result, the abrasion resistance of the frictional contact surfaces between radial plane beating 325 and cylindrical rotor 314*a* is improved. Radial plane bearing 345 has a similar construction as radial plane bearing 325.

In view of the cost, reduction of weight, and durability, radial plane bearings 325, 345 and first and second thrust plane bearings 326, 327 are preferred over conventional bearings, such as a ball bearings.

A discharge port 335 is formed through circular end plate 331 of fixed scroll 330 at a position near the center of spiral element 332. Reed valve member 336 cooperates with discharge port 335 to control the opening and closing of discharge port 335 in response to a pressure difference between first discharge chamber 360 and central fluid pocket 390*a*. Retainer 337 prevents excessive bending of reed valve member 336 when discharge port 335 is opened. An end of reed valve member 336 and an end of retainer 337 are fixedly secured to circular end plate 331 by a single bolt 338. Outer peripheral wall 333 of fixed scroll 330 is fixedly attached to rear annular projection 322 of inner block 320 by a plurality of screws 319.

Figure 3:
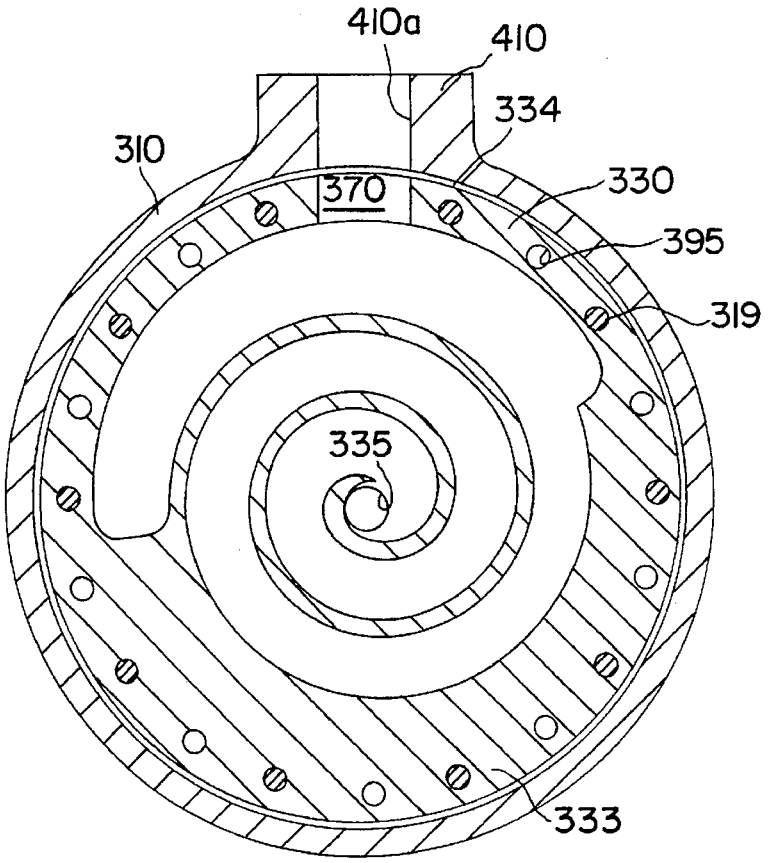
FIG. 3 is a cross sectional view of the suction port mechanism taken along line 3—3 of FIG. 2.
Figure 4:
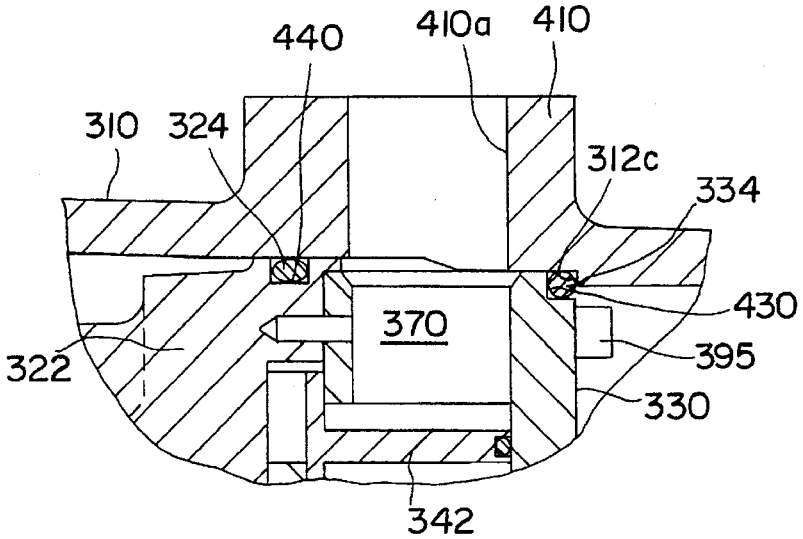
FIG. 4 is an enlarged sectional view of the suction port mechanism in accordance with the first preferred embodiment.

Referring to FIGS. 3 and 4 in conjunction with FIG. 2, fixed scroll 330 includes shoulder portion 430 formed on an outer rear peripheral surface of circular end plate 331. Housing 310 includes annular shoulder portion 312*c* formed on inner peripheral surface thereof. A first annular O-ring 334 is elastically disposed between shoulder portion 430 of fixed scroll 330 and shoulder portion 312*c* of cup-shaped casing 312 to seal the mating surfaces therebetween.

Rear annular projection 322 includes annular groove 440 formed on an outer peripheral surface thereof. Second annular O-ring 324 is elastically disposed in annular groove 440 to seal the mating surfaces between annular projection 322 and cup-shaped casing 312.

First discharge chamber 360 is defined by circular end plate 331 of fixed scroll 330 and a rear portion 312*b* of cup-shaped casing 312. Suction chamber 370 is defined by circular end plate 331 of fixed scroll 330, cylindrical portion 312*a* of cup-shaped casing 312 and inner block 320. Second discharge chamber 380 is defined by inner block 320, cylindrical portion 312*a* of cup-shaped casing 312 and front end plate 311.

Inlet port 310*a* is formed on cylindrical portion 312*a* of cup-shaped casing 312 at a position corresponding to suction chamber 370. Inlet port 310*a* includes a circular opening 410*a* having a diameter preferably equal to or greater than that of suction chamber 370. Outlet port 310*b* is formed on cylindrical portion 312*a* of cup-shaped casing 312 at a position corresponding to second discharge chamber 380.

With particular reference to FIG. 3, a plurality of fluid passages 395 are axially formed through outer peripheral wall 333 of fixed scroll 330 and rear annular projection 322 of inner block 320 so as to link first discharge chamber 360 to second discharge chamber 380.

During operation, as orbiting scroll 340 orbits, the line contacts between spiral elements 332 and 342 cause fluid pockets 390 to move to the center with a consequent reduction in volume and compression of the fluid (e.g., refrigerant) in the fluid pockets 390. Refrigerant gas, which is introduced from a component such as an evaporator (not shown) of a refrigerant circuit (not shown), through fluid inlet port 310*a*, is taken into the fluid pockets 390 from the outer end portion of the spiral elements.

The refrigerant gas taken into the fluid pockets 390 is then compressed and discharged through discharge port 335 into first discharge chamber 360 from the central fluid pocket 390*a* of spiral elements 332 and 342. Thereafter, the refrigerant gas in first discharge chamber 360 flows to second discharge chamber 380 through fluid passages 395. The refrigerant gas flowing into second discharge chamber 380 further flows through outlet port 310*b* to another component, such as a condenser (not shown) of the refrigerant circuit (not shown). In this compressor arrangement, gas pressure is applied to the back side of orbiting scroll 340 as follows: refrigerant and lubricating oil in first discharge chamber 360 flows into second discharge chamber 380 through fluid passages 395. A small portion of the refrigerant and lubricating oil then flows through conduit 328, hollow space 382, axial air gap 383 of first thrust plane beating 326, fluid passage 371, axial air gap 372, the radial air gaps created between boss 343 and radial plane bearing 345, and finally into hollow space 373. The refrigerant and lubricating oil conducted in hollow space 373 flows past and lubricates Oldham coupling mechanism 350 and finally exits into suction chamber 370 at a position outside spiral elements 332, 342.

The foregoing arrangement forms a high pressure compressor. The outlet port is in the front chamber whereas in an ordinary compressor, the outlet port is in the rear chamber. By having the outer port in the front chamber, the high pressure discharge gas can be applied to the back side of the orbiting scroll. The high pressure fluid thus tends to push the orbiting scroll into tight contact with the fixed scroll. Moreover, in this compressor arrangement, the flow path of the high pressure fluid and entrained lubricating oil meanders through the bearings which support the drive shaft. This leads to more lubricating oil typically being delivered across the bearings than in conventional compressor designs where the outlet port is in the rear chamber. Since more lubricating oil is available, less sophisticated bearings may be employed. In the case of the preferred embodiment, plane bearings, which are relatively low in cost, replace costlier ball bearings.

Furthermore, the fluid displacement apparatus of the foregoing arrangement is easier to assemble than the fluid displacement apparatus of the prior art. In the prior art, the scroll member 5 must be assembled within hermetic housing 1 so that its suction port is aligned with the hole in the hermetic housing. Otherwise, suction pipe 17 will not properly open into the suction port. In the compressor of the preferred embodiment, on the other hand, the exact alignment of the suction port of the scroll compressor with inlet port 310*a* is less critical since there is no suction pipe. Furthermore, screws 319 facilitate the alignment of scroll member 330, taking the guesswork out of whether, after the casing 310 is sealed, the suction port 370 and inlet port 310*a* are aligned with one another.

Figure 5:
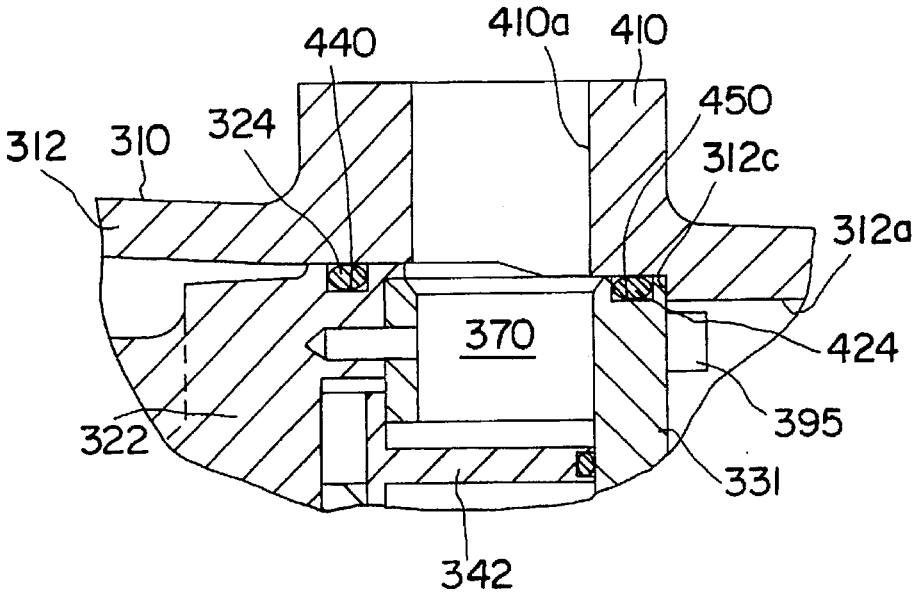
FIG. 5 is an enlarged sectional view of the suction port mechanism in accordance with a second preferred embodiment.

With reference to FIG. 5, there is shown a second preferred embodiment. Elements similar to those in the first embodiment are designated with the same reference numerals, and the discussion will be reserved primarily for the differences between the first and second embodiments. Fixed scroll 330 includes annular groove 450 formed on the outer peripheral surface thereof. A first annular O-ring 424 is elastically disposed within groove 450 to seal the mating surfaces between the outer peripheral surface of fixed scroll 330 and the inner peripheral surface of cylindrical portion 312*a* of cup-shaped casing 312. Second annular O-ring 324 is elastically disposed in annular groove 440 formed on rear annular projection 322 of inner block 320 to seal the portion thereof mating with the inner peripheral surface of cylindrical portion 312*a* of cup-shaped casing 312.

Figure 6:
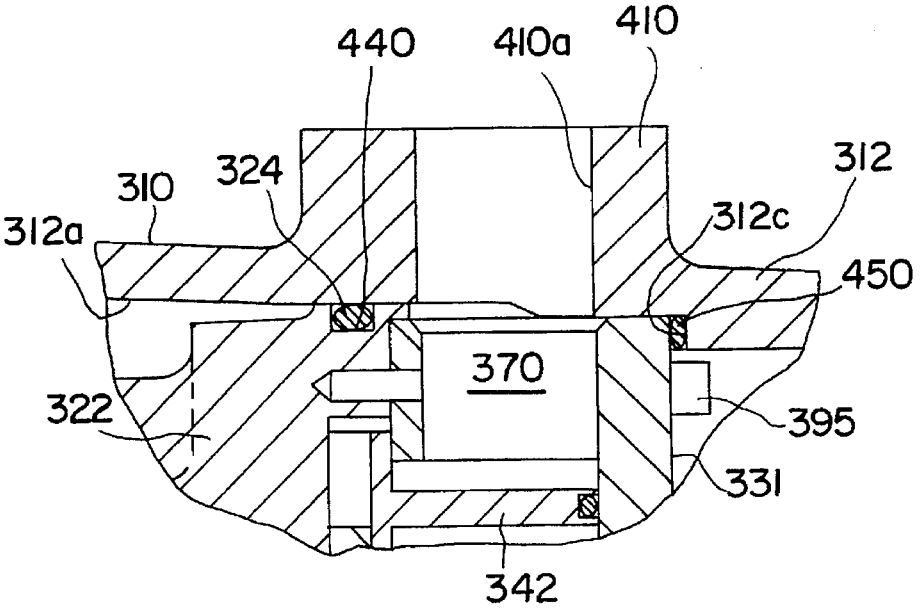
FIG. 6 is an enlarged sectional view of the suction port mechanism in accordance with a third preferred embodiment.

With reference to FIG. 6, there is shown a third preferred embodiment. Annular gasket 450 is secured to shoulder portion 312*c* of cup-shaped casing 312 to seal the mating surface between circular end plate 331 of fixed scroll 330 and shoulder portion 312*c* of cup-shaped casing 312. Further, second annular O-ring 324 is elastically disposed in annular groove 440 of rear annular projection 322 of inner block 320 to seal the portion thereof mating with the inner peripheral surface of cylindrical portion 312*a* of cup-shaped casing 312 to seal the mating surfaces therebetween.

This invention has been described in connection with the preferred embodiments, but these embodiments are merely for example only, and the invention should not be construed as limited thereto. It should be apparent to those skilled in the art that other variations or modifications can be made within the scope of the invention as defined by the appended claims. Thus, while the preferred embodiments illustrate the invention in a scroll type fluid displacement apparatus, the invention can be used in any other high pressure type fluid displacement apparatus.

We claim:

1. A fluid displacement apparatus comprising:

a housing having a cup-shaped casing and an end plate attached to said cup-shaped casing;

a fluid inlet port and a fluid outlet port formed through said cup-shaped casing;

a fluid displacement mechanism disposed within said housing for displacing a fluid from said inlet port to said outlet port, said fluid displacement mechanism dividing an interior of said housing into a first portion and a second portion;

a driving mechanism disposed in said housing and operatively connected to said fluid displacement mechanism;

an inner block fixedly disposed within said housing and supporting a portion of said driving mechanism;

at least one securing means for releasably securing said end plate of said housing to said inner block for accessing the interior of said housing;

means forming a suction chamber communicating with said fluid inlet port;

a first discharge chamber formed in said first portion of said housing and a second discharge chamber formed in said second portion of said housing;

means forming a communication passage connecting said first and second discharge chambers, said second discharge chamber communicating with said fluid outlet port; and sealing means disposed between said suction chamber means and said housing at said fluid inlet port for sealing mating surfaces therebetween.

2. The fluid displacement apparatus of claim 1 wherein said sealing means comprises a plurality of sealing means.

3. The fluid displacement apparatus of claim 2 wherein one of said plurality of sealing means is an O-ring disposed within a groove formed on said inner block.

4. The fluid displacement apparatus of claim 3 wherein at least one of a plurality of said sealing means is an annular sealing member.

5. The fluid displacement apparatus of claim 3 wherein at least one of a plurality of said sealing means is an annular sealing member secured in a shoulder formed on said housing.

6. The fluid displacement apparatus of claim 2 wherein a plurality of said sealing means are O-rings respectively disposed within grooves formed on a projection of said inner block and an outer peripheral surface of said fluid displacement mechanism.

7. The fluid displacement apparatus of claim 1 wherein said housing includes a shoulder portion formed on an interior surface of said housing, said fluid displacement mechanism further comprises a fixed scroll disposed within said housing and having a first end plate from which a first spiral element extends, an orbiting scroll disposed within said housing and having a second end plate from which a second spiral element extends, said first spiral element and said second spiral element interfitting at an angular and radial offsets to form a plurality of line contacts defining at least one pair of sealed-off fluid pockets, and said driving mechanism further comprises a drive shaft axially disposed in said housing and operatively connected to said orbiting scroll to effect orbital motion of said orbiting scroll.

8. The fluid displacement apparatus of claim 1 wherein said sealing means further comprises a plurality of sealing devices, one of which seals mating surfaces of said inner block and an inner peripheral surface of said cup-shaped casing.

* * * * *